United States Patent [19]

Ko et al.

[11] Patent Number: 4,742,350

[45] Date of Patent: May 3, 1988

[54] SOFTWARE MANAGED VIDEO SYNCHRONIZATION GENERATION

[75] Inventors: Michael A. Ko, San Jose, Calif.; John S. Muhich, Austin, Tex.

[73] Assignee: International Business Machines Corporation, Armonk, N.Y.

[21] Appl. No.: 829,357

[22] Filed: Feb. 14, 1986

[51] Int. Cl.[4] ..... G09G 1/16

[52] U.S. Cl. ..... 340/799; 340/735; 340/723; 358/148

[58] Field of Search ..... 340/798, 799, 814, 735, 340/748, 749, 750, 790, 800; 358/148, 150, 151; 375/36

[56] References Cited

U.S. PATENT DOCUMENTS

| | | | |
|---|---|---|---|
| 3,004,242 | 10/1961 | Honeiser . | |
| 3,555,520 | 1/1971 | Helbig et al. . | |
| 3,895,357 | 7/1975 | Schwartz et al. . | |
| 3,947,826 | 3/1976 | Bockwoldt . | |
| 3,996,585 | 12/1976 | Hogan et al. . | |
| 4,013,836 | 3/1977 | Williams | 375/36 |
| 4,057,849 | 11/1977 | Ying et al. | 364/200 |
| 4,068,300 | 1/1978 | Bachman | 364/200 |
| 4,180,805 | 12/1979 | Burson | 340/709 |
| 4,204,207 | 5/1980 | Bakula et al. | 340/799 |
| 4,249,172 | 2/1981 | Watkins et al. | 340/799 |
| 4,280,138 | 7/1981 | Stock | 358/150 |
| 4,412,294 | 10/1983 | Watts et al. | 364/518 |
| 4,454,593 | 6/1984 | Fleming et al. | 364/900 |
| 4,504,828 | 3/1985 | Couper et al. | 340/799 |
| 4,646,077 | 2/1987 | Culley | 340/799 |

OTHER PUBLICATIONS

IBM Technical Disclosure Bulletin, vol. 22, No. 11, Apr., 1980, pp. 4809–4810, "Line Attribute Control".

Motorola CRT Controller (MC6845).

*Primary Examiner*—Gerald L. Brigance

*Attorney, Agent, or Firm*—Thomas E. Tyson

[57] ABSTRACT

A system to display an image including a first memory for storing picture data representing the image attribute data to qualify the picture data. The attribute data includes embedded synchronization data. The system further includes a circuit that produces the image by scanning the picture data qualified by the attribute data onto to a display in accordance with the synchronization data. This invention further provides for storing the synchronization data within the attribute data enabling the synchronization data to be programmable but only requiring update of the synchronization data when the synchronization data is to be changed. The memory includes two buffers wherein one buffer is loaded with attribute and synchronization data while the other buffer is being read. After the other buffer is read, the buffers are toggled such so that the loaded buffer is read to provide the attribute and synchronization data while the previously read buffer is loaded with new attribute and synchronization data. This invention further provides the linking of attribute and synchronization data in the memory to facilitate buffer loading.

13 Claims, 8 Drawing Sheets

SOFTWARE MANAGED VIDEO SYNCHRONIZATION GENERATION

DESCRIPTION

1. Technical Field

This invention relates to video display systems and more specifically to a video display system providing programmable video synchronization capability.

2. Background Art

Cathode ray tube display terminals require both display content information and synchronization information to properly display a video image. Typically, in computer display terminals, video generation includes a character generator that provides character output in a fixed format for video display. More recently, the capability to display individual addressable picture elements (pixels or pels) have been provided making possible graphics display terminals. The addressability of individual pel data is provided in a system termed "all points addressable" which allocates a memory cell for each pel on the display. This addressability configuration enables the programming of each individual pel location on the display.

This additional programming capability has not extended to the generation of the synchronization signals for these displays. The synchronization signals are required to control the electron beam scanning in a cathode ray tube display. The horizontal synchronization signal is used to return the scanning beam to the beginning of the next horizontal line. The vertical synchronization signal is used to return the scanning beam to the upper left hand corner to begin the display of a new image.

Traditionally, the generation of both the horizontal synchronization signal and a vertical synchronization signal has been accomplished by the use of counters or timers. This hardware implementation restricts the programmability of the horizontal and vertical synchronization signals.

A traditional character display system is disclosed in U.S. Pat. No. 3,555,520 entitled "Multiple Channel Display System". This patent discloses a display system having several memories where each memory stores character codes that are input to character generators. The output of the character generators are provided to the video display. The character generators also provide the horizontal synchronization signal as a function of the number of characters per line.

An example of current display generation is the Motorola CRT Controller, part no. MC6845. This controller includes programmable horizontal and vertical timing generators that generate the horizontal and vertical synchronization signals.

Another example of a display system including counters for synchronization is disclosed in U.S. Pat. No. 4,180,805 entitled "System for Displaying Character and Graphic Information on a Color Video Display with Unique Multiple Memory Arrangement". This patent discloses a display system including a memory having addressable words that correspond to character positions on the display. Counters are used to address this display memory and further to generate the horizontal and vertical synchronization signals for the display.

One technique that has been used to provide programmability of the horizontal and vertical synchronization signals includes a stream of pel data with horizontal and vertical synchronization data embedded at the appropriate locations. This technique places a large overhead on the software, since the software is not only responsible for generating the data stream with the pel information but also to include, in the appropriate data stream location, the synchronization data.

DISCLOSURE OF THE INVENTION

In accordance with the present invention, a system to display an image is provided that includes a storage means for storing picture data representing the image and attribute data to qualify the picture data. This attribute data includes synchronization data. This invention further includes a circuit that produces the image by scanning the picture data qualified by the attribute data in accordance with the synchronization data onto a display.

In a preferred embodiment of the present invention, the display system includes two last-in, first-out (LIFO) buffers that are connected to a processor and memory on one and to a combinational logic decoding circuit on the other. The output of the combinational logic decoding circuit is connected to a video output circuit. The two buffers are further connected to counters which provide addressing of the data stored in the buffers. In this embodiment, the picture element data (pel data) is stored in a separate portion of the memory from the attribute data. The pel data is output separately to the video output circuit.

The attribute data is used to qualify each individual pel location to provide functions such as blinking, highlighting or reverse video. Embedded in the attribute data is horizontal and vertical synchronization data. The attribute data including the synchronization data embedded therein is output from the memory and temporarily stored in the LIFO buffers. The location of the synchronization data may be consistently maintained in the buffer allowing the updating of the attribute data while not requiring the software to update the synchronization data. Attribute data is read from one LIFO buffer into the decode circuit until the synchronization data is read. A control circuit then switches to the second LIFO buffer to provide the data output. The first buffer, previously read, is then loaded with new attribute data. If the existing synchronization data is not to be changed, this additional synchronization data does not have to be reloaded since it remains in the LIFO buffer. When the second buffer is read, the decode circuit is reconnected to the first buffer containing the new attribute data and the second buffer is then loaded with additional attribute and synchronization data if required. Operating in this manner, the system provides a continuous data stream of attribute data and synchronization data to the video circuit without requiring constant updating of synchronization data unless the synchronization data is to be changed.

A further enhancement of the present invention includes the storing of attribute data (including the synchronization data) in an easily managed linked list structure. The attribute data is easily loaded into the LIFO buffers as a continuous data stream. Further, the invention provides for run length specification allowing a single attribute to qualify several consecutive pels. By specifying data in this manner, as opposed to specifying a single attribute for each individual pel, total system memory is conserved.

Further, a method for displaying an image is disclosed. It consists of the steps of (a) storing picture data representing the image in a first memory, (b) storing attribute data for qualifying the display of the picture data and further synchronization data in a second memory, and (c) scanning the picture data qualified by the attribute data in accordance with the synchronization data onto to a display.

BRIEF DESCRIPTION OF DRAWING

Still further objects and advantages of the invention will become apparent from the detailed description in the claims when read in conjunction with the accompanying drawings wherein:

DETAILED DESCRIPTION OF PREFERRED EMBODIMENT

This invention addresses the storage of information required to display an image on a cathode ray tube or similar type of display. The cathode ray tube produces an image on a display face by scanning a stream of electrons across a phosphorus laden surface. The present invention addresses the storage of individual image elements, termed picture elements, pixels or pels together with data used to qualify the display of each pel. The qualifying data is termed attribute data and provides for a pel to be displayed in reverse video, as blinking, or as highlighted. Since the image data is produced by a stream of electrons scanned across this phosphorus surface, control of this scanning process must also be provided. In cathode ray tube displays, the horizontal and vertical synchronization signals are used to reposition the scanning stream of electrons to produce the image on the phosphorus surface.

The present invention provides for the storage of pel data, attribute data, and synchronization data. The synchronization data is used to provide both horizontal and vertical synchronization signals. The storage of pel data, attribute data and synchronization data in this invention is provided in a manner that results in ease of programmability of the pel, attribute and synchronization information.

Figure 1:
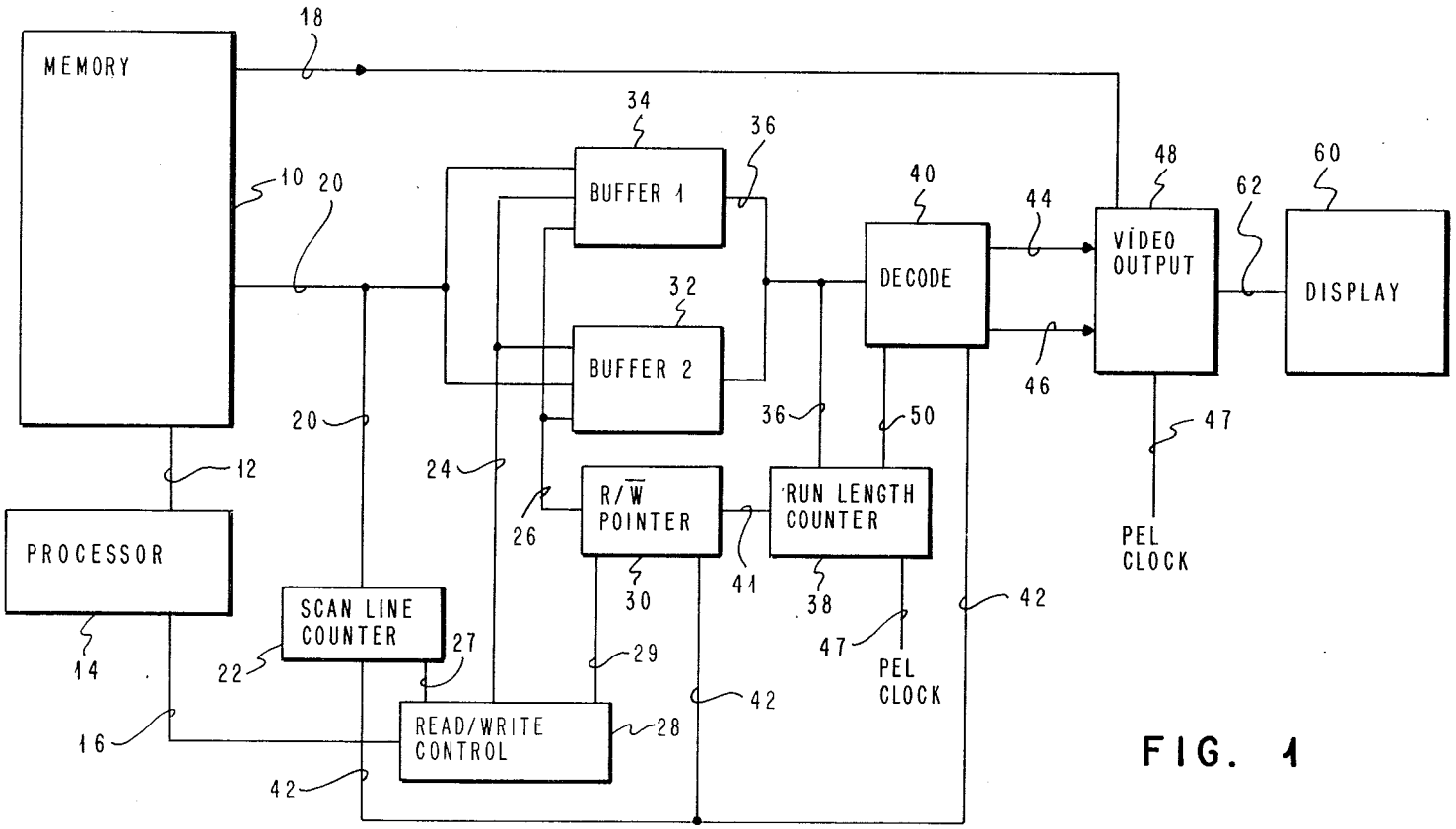
FIG. 1 is a block diagram of the display system.

FIG. 1 is a block diagram illustration of the present invention. Memory 10 provides storage for both pel data and attribute data. The pel data is normally stored in a bit map fashion, i.e., each memory cell represents a pel on the display. The attribute data and the synchronization data are, however, stored in a unique fashion providing both memory conservation and ease of programmability. In the present embodiment, the pel data is provided on line 18 to a video output circuit. The attribute data and synchronization data are output on line 20 to buffers 32 and 34. The contents of the buffers 32 and 34 are decoded in decode circuitry 40 which provides attribute information on line 44 and synchronization information on line 46 to the video output circuit 48. The video output circuit 48 then provides the video signal on lines 62 to a display 60.

The loading of attribute and synchronization data into buffers 32 and 34 is accomplished under control of processor 14. Processor 14 controls the memory 10 output via line 12. Processor 14 also controls buffers 32 and 34 through the read/write controls circuit 28 via line 16. The read/write control circuit 28 is connected to both buffers 32 and 34 via line 24 to individually control the input and output of data into buffers 32 and 34. The read/write control circuit 28 also provides the loading of data into the scan line counter 22 via line 27. The scan line counter 22 receives this data on line 20 from the memory 10.

The read/write control circuit 28 further controls the R/W- pointer 30 (the read/write pointer for the buffers 32 and 34) in a manner to be discussed.

The output of information from buffers 32 and 34 is predominantly controlled by the R/W- pointer 30 and the run length counter 38. These buffers 32 and 34 are operated in an alternating or "ping pong" fashion whereby one buffer is loaded while the other buffer is read. When the loading and read operations are complete, the buffers 32 and 34 are switched so that the newly loaded buffer is then read and the newly read buffer is then reloaded. Information from buffers 32 and 34 is provided on line 36 to the run length counter 38 and to the decode circuitry 40.

The decode circuitry 40 decodes the data from buffers 32 and 34 to provide the synchronization signal on line 46 and the attribute signals on line 44 to the video output circuit 48. The incrementing of information through the decode circuit 40 is accomplished through the run length counter by a pel clock on line 47. The pel clock signal on line 47 is also provided to the video output circuit 48. A combination of the attribute data on line 44, the synchronization data on line 46, and the pel data on line 18 to the video output circuit line 48 enables the video output circuit 48 to provide a combined video signal on line 42 to display 60 that contains the desired image.

Figure 2:
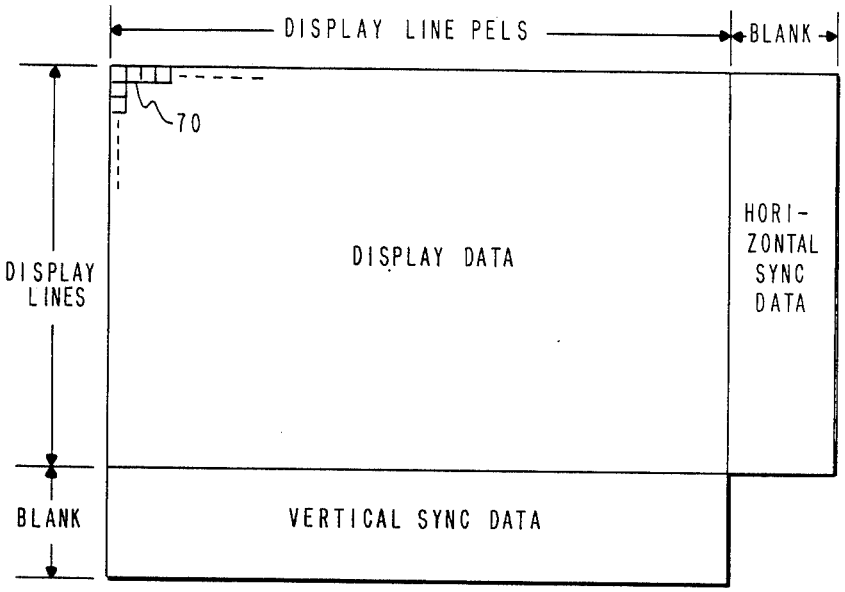
PRIOR ART FIG. 2
FIG. 2 is an illustration of a prior art image storage scheme.

It should be understood that the advantages of this invention include not only the specific scheme of storage of data in memory 10 but also the operation of the buffers 32 and 34 and the related control circuitry. To explain this invention, traditional bit map storage will be discussed. FIG. 2 illustrates in a symbolic form the bit map storage of display data in memory. Each memory element such as element 70 includes information for a single pel or attribute information for a single pel. Each display line includes a series of memory elements 70 for each pel of the display line as illustrated in FIG. 2. In addition, a display line includes several memory locations that define a blanking period for the horizontal synchronization data. This blanking period is provided to turn off the stream of electrons as the beam returns from one side of the display to the other side to begin scanning a new line. Also, in a similar fashion, the blanking for the vertical synchronization data is provided. The vertical synchronization data is required to turn off the stream of electrons as the beam is returned to the upper left hand portion of the display to begin scanning. Therefore, in the traditional bit map mode, the pel information together with the blanking information is defined by the memory cells allocated in a fashion illustrated in FIG. 2.

Figure 3:
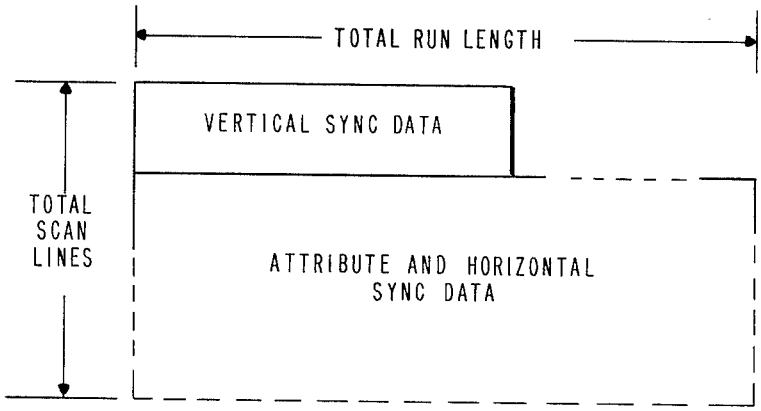
FIG. 3 is an illustration of the image storage scheme according to the present invention.

The present invention defines a data storage scheme for attribute and synchronization data that is illustrated in FIG. 3. The actual memory required is not that of the bit map scheme of FIG. 2 but will vary as to the type and method of information storage. Specifically, attribute data may be stored to qualify more than one pel. Further, horizontal synchronization data may be stored that will specify blanking for more than just single display line. In this scheme, the storage required for vertical synchronization data may vary. The only requirement for the display line is that total run length number for attributes and horizontal synchronization information for a single line be equivalent to the total number of display line pels memory locations and blanking memory locations of FIG. 2. Likewise, the total number of scan lines used to define attribute and synchronization data should also be equivalent to the number of display lines and blanking lines of FIG. 2. It should be appreciated that deviating from a scheme which provides a memory cell per pel result in a savings in memory. Additionally, by reusing data previously stored, such as horizontal and vertical synchronization data, the reprogramming of horizontal and synchronization data will not be required as is required for the bit map scheme of FIG. 2.

Figure 4A:
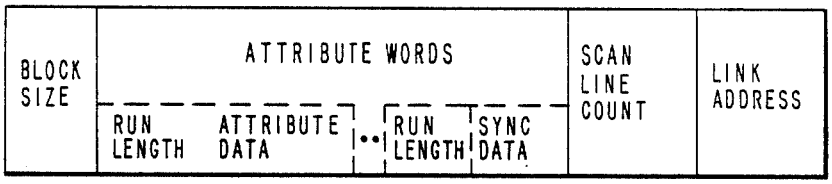
FIG. 4*a* is an illustration of a memory storage element containing attribute and synchronization data in accordance with the present invention.

Instead of a bit map scheme of FIG. 2, attribute and synchronization information is stored according to a scheme illustrated in FIG. 4*a*. FIG. 4*a* illustrates a variable length memory storage element for attribute information. This attribute information can include both attribute data and synchronization data. The beginning portion of this information is the block size. The block size specifies the number of attribute words contained. A single attribute word is defined as including run length information and attribute data or synchronization data. Run length data is the number of pels that are to be qualified by the attribute data. Concerning synchronization data, the run length information is equated to a number of time periods that the beam is to be blanked in accordance with the synchronization data. The synchronization data also may contain the horizontal or vertical synchronization signal which indicates to the video output circuitry 48 reposition the electron beam to the appropriate position. After the specification of attribute words, the memory element includes a scan line count and the link address. The link address defines the location of the next variable length attribute information. The scan line count defines the number of vertical display lines that are to be qualified by the attribute words of the attribute information address by the link address.

Figure 4B:
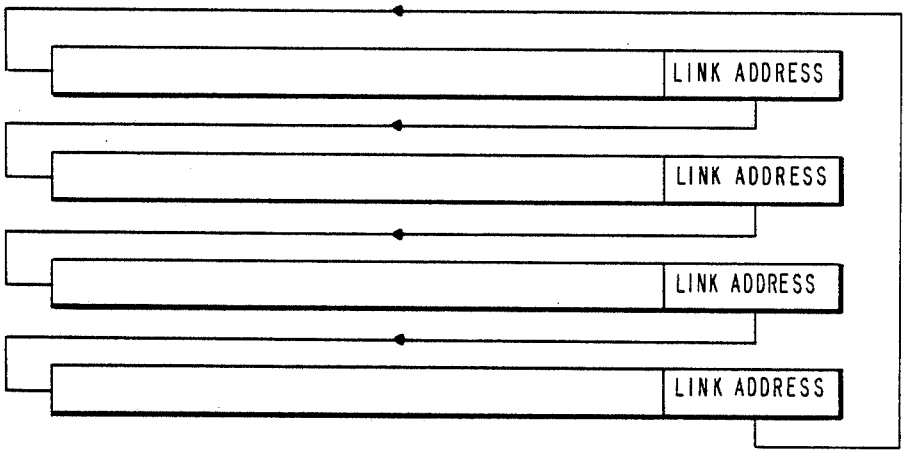
FIG. 4*b* is an illustration of data stream construction in accordance with the present invention.

FIG. 4*b* illustrates the location of the attribute information in memory 10 and the use of the link addresses to link together the information elements into a continuous data stream. Therefore, in transferring the attribute information from memory 10 to the buffers 32 and 34, processor 14 employs the link address to direct the access of the next attribute information element in memory 10 to provide a continuous data stream.

Figure 5A:
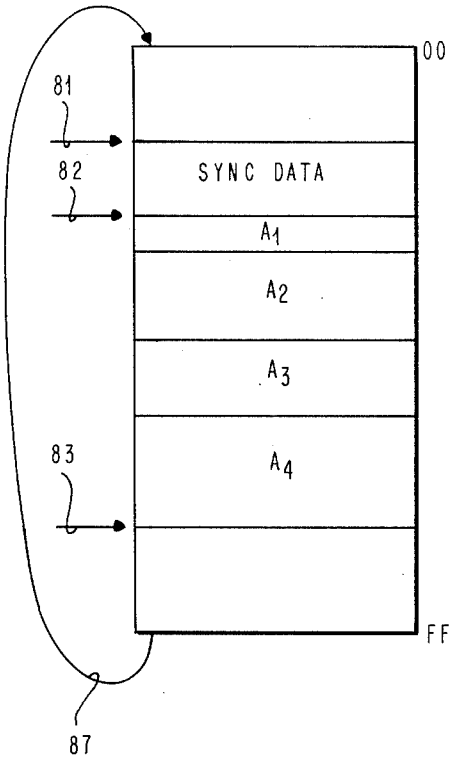
FIG. 5*a* is an illustration of the contents of a buffer.

FIG. 5*a* illustrates the memory map for a single LIFO buffer such as buffer 32 or 34. Each buffer, 32 and 34, is circular in that the pointer, illustrated by lines 81, 82, and 83, can vary anywhere from hex '00' to hex 'FF' and, if incremented again, will return to location hex '00'. Data stored in the buffer illustrated in FIG. 5*a*, is stored in a circular fashion. Referring to FIG. 5*a*, line 81 denotes the beginning pointer location for the storage of data. The synchronization data is first stored at the address denoted by pointer 81. After the storage of the synchronization data, the pointer is at the location denoted by line 82. At this point attribute data, denoted by $A_1$ through $A_4$ is stored. At this time the pointer is located at line 83.

When the buffer data is transmitted, the pointer will decrement back to position 81. In this manner, the attribute data $A_1$ through $A_4$ will sequentially be transmitted with $A_4$ being first followed by $A_3$, etc. At the end of the sequence, the synchronization data will be transmitted.

Figure 5B:
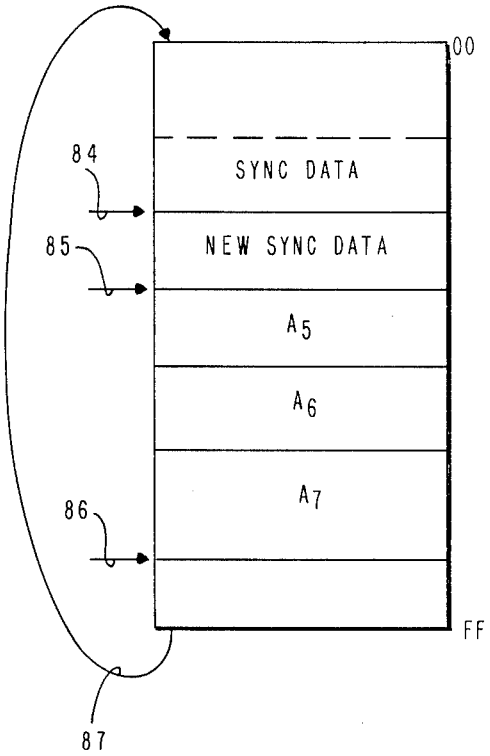
FIG. 5*b* is an illustration of the contents of the buffer of the FIG. 5*a* after it has been reloaded.

When this buffer is reloaded, its configuration will change as illustrated in FIG. 5*b*. If the new information loaded in the buffer includes new synchronization data, the synchronization data will begin loading at the pointer location designated by line 84. The read/write pointer should be preincremented by the number of synchronization data words required to complete synchronization. In the preferred embodiment, the number is 3 as illustrated by the 3 pre-increment block in FIG. 8. After the load of this new synchronization data, the pointer will be located as indicated by line 85. Then additional attribute information, such as $A_5$ through $A_7$ will be loaded resulting in the pointer being located at the address represented by line 86. It should be understood that if no new synchronization data is loaded, the pre-existing synchronization data will be used. Therefore, if no changes in the synchronization data is required, new synchronization data need not be reloaded since the existing synchronization data will be repeatedly output in the data stream containing the attribute information.

Figure 6A:
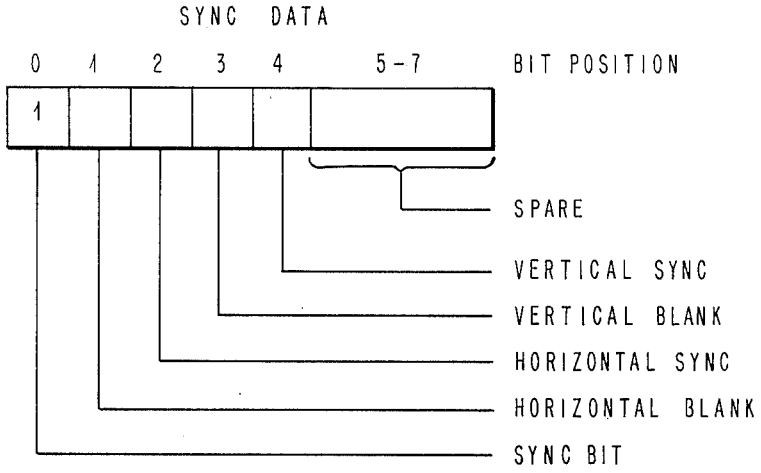
FIG. 6*a* is an illustration of the synchronization data bit information.
Figure 6B:
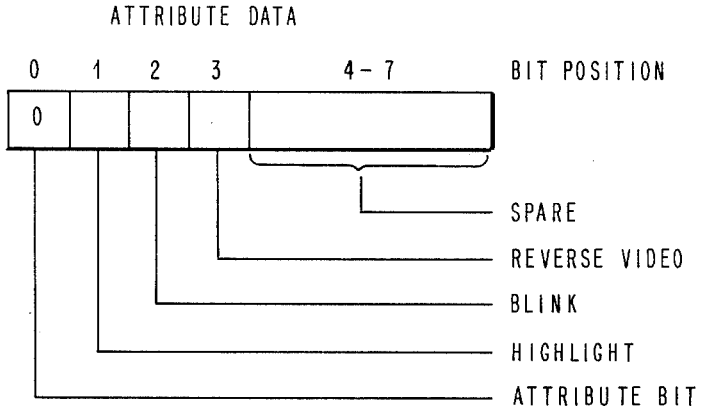
FIG. 6*b* is an illustration of the attribute data bit information.

FIGS. 6*a* and 6*b* illustrate the contents of the synchronization data and attribute data. In FIG. 6*a* the synchronization data includes a synchronization bit in bit position 0 which designates the byte as synchronization data. Bit position 1 designates a horizontal blank and bit position 2 designates a horizontal synchronization signal. It should be understood that the number of time periods for blanking will be specified by the run length data that precedes the synchronization data. Since the horizontal synchronization signal indication is independent of time period, the run length data is ignored for a synchronization indication. Likewise, the vertical blank bit position 3 designates vertical blanking. However, the number of lines to be vertically blanked is specified by the scan count. The vertical synchronization signal is designated by bit 4 in a manner similar to the horizontal synchronization signal. The remaining bit positions 5–7 are spares.

In FIG. 6*b*, the attribute data is specified by bit position 0, which differentiates the attribute data byte from the synchronization data byte previously discussed. bit position 1, 2, and 3 signify highlighting, blinking, and reverse video respectively. Bit positions 4–7 are spares that may be used to specify further attributes.

Figure 7:
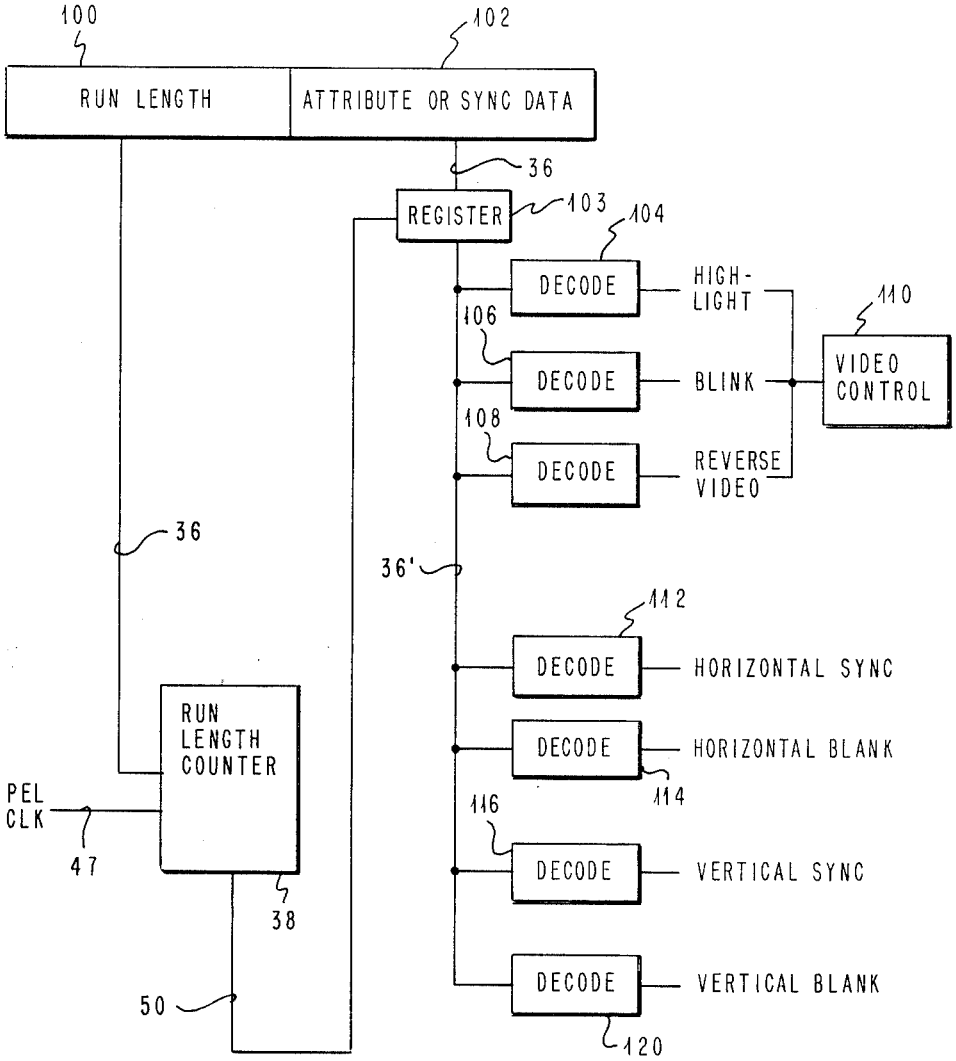
FIG. 7 is a block diagram illustrating the operation of the run length counter and the decode circuitry.

FIG. 7 is a block diagram illustrating the decode circuitry 40 and the run length counter 38. Each buffer 32 and 34 contains the attribute or synchronization information that includes the run length 100 and attribute or synchronization data information 102. The data information 102 corresponds to the 8 bit word that are discussed in FIGS. *6a* and *6b*. The run length portion 100 is loaded on line 36 into the run length counter 38. The attribute or synchronization data 102 is loaded by line 36 into the decode circuit register 103. The contents of register 103 is then decoded by the circuitry connected to line 36'. The run length counter determines the length of time (defined of pel clock periods) each of the data words in register 103 is decoded. In other words, if the run length 100 is 10, the run length counter 38 will provide the corresponding attribute or synchronization data in register 103 for 10 pel clock periods. The pel clock is input on line 47. The run length counter actually inputs the run length count on line 36 and decrements this count each time a pel clock signal is received on line 47. When the run length count has been depleted, a signal is provided on line 50 which reloads register 103 with the next successive attribute or synchronization data and loads the next run length count for that attribute or synchronization data. The contents of register 103 is decoded to provide, for example, one of the three attributes highlight, blink, reverse video through the decode circuits 104, 106, and 108. These attribute signals are provided to a video control circuit 110 which is actually part of the video output circuit 48 in Figure 1. Decode circuits 112 and 114 provide the horizontal synchronization and horizontal blank signals respectively. Similarly, the decode circuits 116 and 120 provide the vertical synchronization and the vertical blank signals. The decode circuits 104, 106, 108, 112, 114, 116, and 120 are simple combinational logic circuits that decode the attribute as in *6b*.

Referring back to FIG. 1, the synchronization data on line 46 and the attribute data on line 44 is provided to the video output circuit 48. This video output circuit 48 combines the attribute data on line 44 with the pel data on line 18 to form a video signal. The video signal may include the synchronization information on line 46 to provide the combined video signal on line 62. The video output circuit 48 can be any standard video output circuit for combining pel attributes with pel data such as the IBM PC monochrome adapter card referred to in the IBM Personal Computer technical reference, herein incorporated by reference. The display 60 can be any monitor that displays a video signal or any other similar video type signal.

Figure 8:
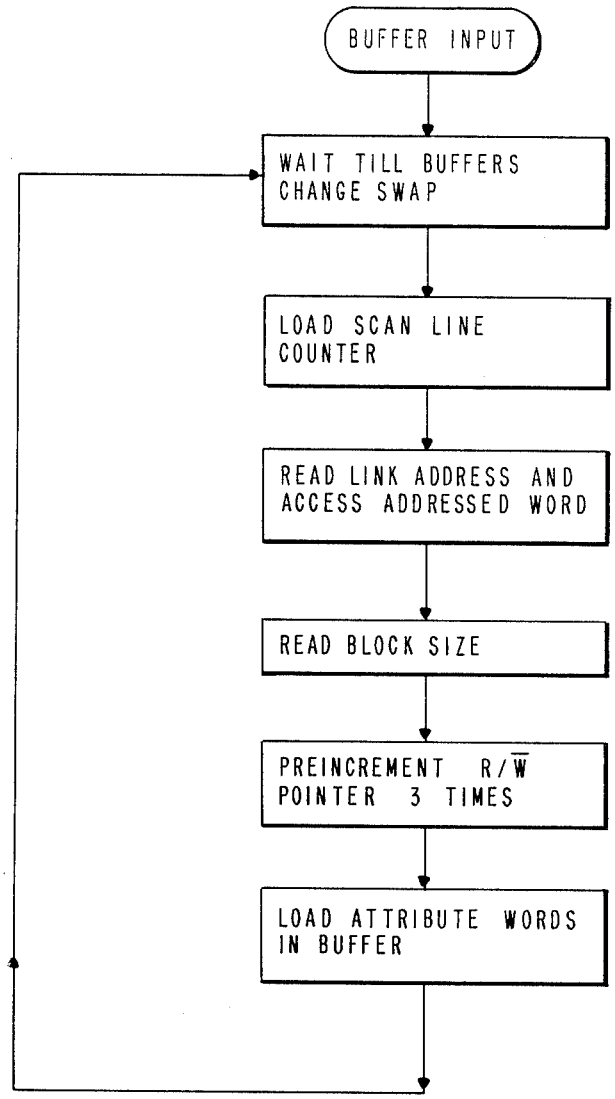
FIG. 8 is a flow chart depicting the sequence of operations to load a buffer.

The operation of the circuitry in FIG. 1 includes two main operation modes: buffer input and buffer output. The buffer input sequence is outlined in FIG. 8. In the preferred embodiment of FIG. 1, processor 14 controls the event sequence illustrated in FIG. 8. The actual buffers are directly controlled by the read/write control circuit 28 as previously discussed. Referring to FIG. 8, the buffer to receive input data is first enabled by the read control circuit 28 to receive this data on the data lines 20 from memory 10. The scan line count is first loaded into the scan line pointer 22 via line 20. In the preferred embodiment and as previously discussed, the scan line count refers to the scan lines to be modified by the attribute words addressed by the link address. Next, the link address and block size are read and the buffer read/write pointer 30 is incremented over the existing synchronization storage in the buffer as previously discussed and illustrated in FIG. *5b*. In this fashion, the existing synchronization data in the LIFO is preserved. The attribute words including attribute data and, if required, synchronization data is then loaded into the buffer. Since the buffer is a last in first out buffer, the read/write pointer 30 is set to point to the last data input to the buffer. The buffer is then signaled full and ready to provide output data. The processor 14 and read/write control circuit 28 is now prepared to repeat this sequence, whenever the scan line counter is depleted.

Figure 9:
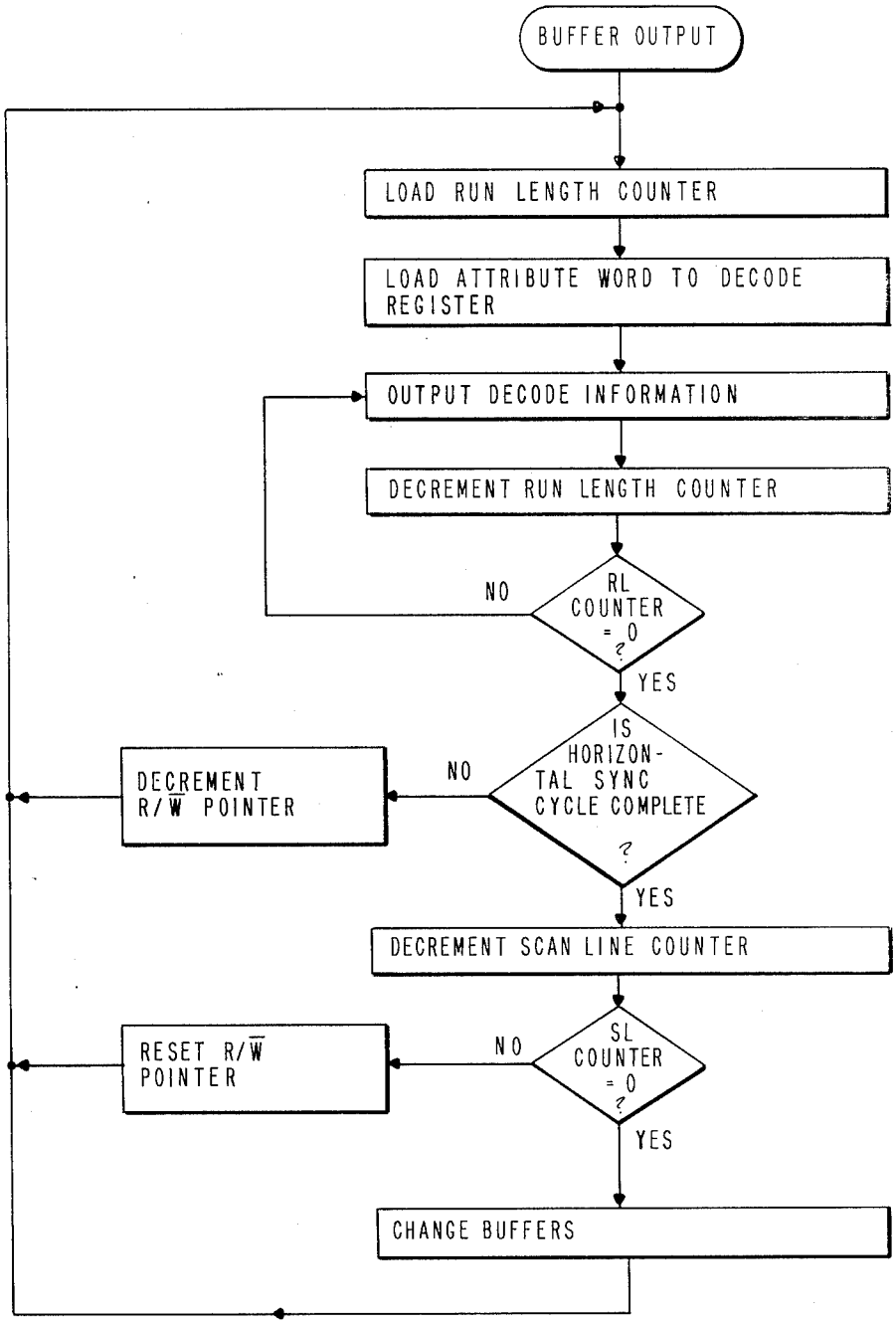
FIG. 9 is a flow chart illustrating the sequence of operations for outputting data from a buffer.

FIG. 9 illustrates the event sequence for the output of data from the buffer. In the preferred embodiment, the control of the sequence is provided by dedicated logic. After the buffer output has been enabled, the first word of the buffer is read. Specifically, the run length is loaded into the run length counter and the attribute word containing either attribute data or synchronization data is loaded into the decode register 103 as previously discussed. The information into the decode register 103 is then decoded by the appropriate decode circuitry and the signal is produced for one pel clock period. The run length counter 38 receiving the pel clock signal on line 47 is then decremented. If the run length counter is not zero then the information in the decode circuit register 103 is output again. When the run length counter finally is decremented to zero and if a horizontal synchronization signal is not present, then the buffer read/write pointer 30 is decremented and the next buffer word is then loaded into the run length counter 38 and decode register 103 as before. If the horizontal synchronization cycle is complete, this then denotes the end of the attribute code line. The scan counter 22 is then decremented and if the scan counter is not zero, then the buffer read/write pointer 30 is then reset to its original loaded position to repeat the lists of attributes for the next scan line. If the scan line counter is zero, then the buffer has been exhausted and the read/write control circuit 28 receives the indication from the scan line pointer 22 on line 27 that the buffers are to be changed.

The alternation of input and output of buffers 32 and 34 in a manner outlined in FIGS. 8 and 9 provide for a continuous flow of attribute and synchronization data to the decode circuitry 40. The storage of data in memory 10 using the link addresses and the data format providing scan count and run length conserve memory space in memory 10 and provide a continuous data stream. In addition, the inclusion of the synchronization data in memory 10 with attribute data and the unique read/write pointer mechanism for buffers 32 and 34 provide for the ease of programming the synchronization data and remove the burden of continuous reprogramming the same synchronization data from the software.

Other embodiments and modification of the present invention will readily become apparent to those of ordinary skill in the art having the benefit of the teachings presented in this forgoing description and drawing. It is therefore to be understood that this invention is not to be limited thereto and that these modifications and embodiments are intended to be within the scope of the appended claims.

We claim:

1. A system to display picture data comprising:

means for storing a plurality of information blocks of picture data and picture attribute data with picture synchronization data, said attribute and synchronization data blocks being stored noncontiguously and each including interlinking address information representing a continuous data stream of said picture attribute data and synchronization data;

means for accessing said storage means and providing a continuous data stream of picture data, picture attribute data and synchronization data wherein said providing means provides said continuous data stream of said picture attribute data and synchronization data for qualifying said picture data; and means for forming a stream of video data representing the picture data by qualifying said picture data in accordance with said continuous data stream of said picture attribute data and synchronization data.

2. A system according to claim 1 wherein said accessing and providing means further includes means for storing additional picture attribute data and said synchronization data while transmitting said data stream to said forming means.

3. A system according to claim 2 wherein said accessing means further includes a plurality of buffers which store said picture attribute data and said synchronization data.

4. A system according to claim 3 wherein said accessing and providing means further includes means for loading at least one of said buffers with additional picture attribute data and synchronization data while simultaneously said storing and transmitting means transmits said data stream from a second of said buffers.

5. A system according to claim 4 wherein said accessing and providing means further includes switching means for switching to a loaded buffer when said transmitting buffer is empty.

6. A system to display an image composed of a plurality of picture element data in accordance with corresponding attribute data, said system comprising:

means for storing said picture element data;

means for storing a plurality of data blocks, each including at least one attribute specification entry for at least one picture element and a specified number of picture elements to be displayed according to the attribute specification entry;

means for forming a continuous stream of video data representing said image from said picture data qualified by said attribute data entries; and display means for displaying said image from said video data.

7. A system according to claim 6 wherein said data blocks are stored noncontiguously and further include addresses linking the data blocks to form a continuous data stream for said forming means.

8. A system according to claim 7 wherein said data block storing means includes a plurality of buffer memories connected to a main memory wherein the storing means loads one of said buffer memories while said forming means is reading another one of said memories.

9. A system according to claim 8 wherein said forming means includes decoding means to decode the attribute specification for qualifying the specified number of picture elements during forming the continuous data stream of video data.

10. A system to display an image composed of a plurality of picture element data in accordance with corresponding attribute data, said system comprising:

means for storing said picture element data;

means for storing a plurality of data blocks, each including at least one attribute specification entry for at least one picture element and a link address providing the address of a next data block, said link addresses collectively providing a loop of said data blocks;

means for forming a continuous stream of video data representing said image from said picture data qualified by said data block loop of attribute data entries; and display means for displaying said image from said video data.

11. A system according to claim 10 wherein said attribute data includes synchronization data.

12. A system according to claim 11 wherein said attribute data includes a specified number of picture elements that are to be qualified by each attribute data entry.

13. A system according to claim 12 wherein said synchronization data includes a number that specifies a number of repeatable time periods for synchronization.

* * * * *